US005291122A

United States Patent [19]

Audy

[11] Patent Number: 5,291,122

[45] Date of Patent: Mar. 1, 1994

[54] BANDGAP VOLTAGE REFERENCE CIRCUIT AND METHOD WITH LOW TCR RESISTOR IN PARALLEL WITH HIGH TCR AND IN SERIES WITH LOW TCR PORTIONS OF TAIL RESISTOR

[75] Inventor: Jonathan M. Audy, Campbell, Calif.

[73] Assignee: Analog Devices, Inc., Norwood, Mass.

[21] Appl. No.: 897,312

[22] Filed: Jun. 11, 1992

[51] Int. Cl.[5] ..... G05F 3/16

[52] U.S. Cl. ..... 323/313; 323/907; 307/296.1

[58] Field of Search ..... 323/313, 314, 315, 316, 323/907; 307/296.1, 296.6, 296.8

[56] References Cited

U.S. PATENT DOCUMENTS 4,263,544 4/1981 Groendijk ..... 323/313
4,808,908 2/1989 Lewis et al. ..... 323/313

OTHER PUBLICATIONS

Grebene, Bipolar and MOS Analog Integrated Circuit Design, John Wiley & Sons, 1984, pp. 206-209.

*Primary Examiner*—Steven L. Stephan
*Assistant Examiner*—Y. Jessica Han
*Attorney, Agent, or Firm*—Koppel & Jacobs

[57] ABSTRACT

A bandgap voltage reference circuit includes a low temperature coefficient of resistance (TCR) tail resistor connected in series with a high TCR tail resistor, and a low TCR correction resistor connected in parallel with the high TCR resistor. The ratio of resistance values for the parallel resistors is selected to produce a correction voltage that essentially cancels a Tln(T) output deviation from temperature linearity, where T is absolute temperature. Matching voltage-temperature characteristics are obtained by selecting a resistor ratio at which the rate of change in the circuit's output voltage, both with and without the parallel resistors, is substantially zero at approximately the same temperature. While the shape of the compensation voltage-temperature curve is determined by the resistor ratio, it is scaled to the magnitude of the Tln(T) deviation by an appropriate selection of absolute resistor values. The correction resistor is preferably a trimmable thin film element.

19 Claims, 4 Drawing Sheets

BANDGAP VOLTAGE REFERENCE CIRCUIT AND METHOD WITH LOW TCR RESISTOR IN PARALLEL WITH HIGH TCR AND IN SERIES WITH LOW TCR PORTIONS OF TAIL RESISTOR

BACKGROUND OF THE INVENTION

1. Field of the Invention

This invention relates to bandgap voltage reference circuits, and more particularly to such circuits in which an attempt is made to correct for a Tln(T) deviation from linearity in the output voltage.

2. Description of the Prior Art

Bandgap reference circuits have been developed to provide a stable voltage supply that is insensitive to temperature variations over a wide temperature range. These circuits operate on the principle of compensating the negative temperature drift of a bipolar transistor's base-emitter voltage ($V_{be}$) with the positive temperature coefficient of the thermal voltage $V_T$, which is equal to kT/q, where k is Boltzmann's constant, T is the absolute temperature in degrees Kelvin and q is the electronic charge. A known negative temperature drift due to $V_{be}$ is first generated. A positive temperature drift due to the thermal voltage is then produced, and is scaled and subtracted from the negative temperature drift to obtain a nominally zero temperature dependence. Numerous variations in the bandgap reference circuitry have been designed, and are discussed for example in Grebene, *Bipolar and MOS Analog Integrated Circuit Design,* John Wiley & Sons, 1984, pages 206–209.

Although the output of a bandgap voltage cell is ideally independent of temperature, or at least varies linearally with temperature, the outputs of prior cells have been found to include a term that varies with Tln(T), where ln is the natural logarithm function. Such an output deviation is shown in FIG. 1, in which the bandgap voltage output ($V_{bg}$) increases from a value of about 1.2408 volts at −50° C. to about 1.2444 volts at about 45° C., and then returns back to about 1.2408 volts at 150° C. This output deviation is not symmetrical; its peak is skewed about 5° C. below the midpoint of the temperature range.

It is difficult to precisely compensate for the Tln(T) deviation electronically, so simpler approximations have been used. One such circuit is shown in FIG. 2, and is described in U.S. Pat. No. 4,808,908 to Lewis et al., assigned to Analog Devices, Inc., the assignee of the present invention. The circuit includes bipolar npn transistors Q1 and Q2, with the emitter area of Q2 scaled larger than that of Q1 by a factor A. The emitters of Q1 and Q2 are connected together through a resistor R1 that has a relatively low temperature coefficient of resistance (TCR). A second relatively low TCR resistor R2 is connected in series with a relatively high TCR resistor R3 between the R1/Q1 emitter junction and a negative (or ground) voltage bus V−. Q1 and Q2 are provided with collector currents with a constant ratio between the current magnitudes, such as by connecting their collectors respectively to the inverting and non-inverting inputs of an operational amplifier. R1 and R2 are preferably implemented as thin film resistors, with TCRs on the order of 30 ppm (parts per million)/°C.; such low TCRs may be considered to be negligibly small for purposes of the invention. R3 is preferably a diffused resistor having a TCR of typically 1,500–2,000 ppm/°C.

The output voltage $V_{bg}$ is equal to the sum of $V_{be}$ for Q1 and the voltage drops across R2 and R3. In the absence of R3, the voltage across R2 can be determined by considering the voltage across R1. This is equal to the difference in $V_{be}$ for Q1 and Q2; since the emitter of Q2 is larger than the emitter of Q1 but both transistors may carry equal currents, the emitter current density of Q2 will be less than for Q1 and Q2 will accordingly exhibit a smaller $V_{be}$. The $V_{be}$ differential between Q1 and Q2 will have the form $V_T\ln(Id1/Id2)=V_T\ln(A)$, where I1 and I2 are the absolute emitter currents, and Id1 and Id2 are the emitter current densities of Q1 and Q2, respectively. Since I1 is preferably equal to I2, the current through R2 will be twice the current through R1, so that the voltage across R2 will have the form $(2R1/R2)V_T\ln(A)$. Still ignoring R3, the described circuit will exhibit the Tln(T) output deviation mentioned above.

The addition of high TCR resistor R3 approximates a Tln(T) output voltage compensation by producing a square law ($T^2$) term that is added to $V_{bg}$. Since the tail current through R2 is proportional to temperature anyway, adding a significant temperature coefficient by means of the high TCR tail resistor R3 yields a voltage across this resistance that is proportional to $T^2$. Combining this square law voltage with the voltage across R2 and $V_{be}$ for Q1 approximately cancels the effect of the Tln(T) deviation.

R3 is preferably a diffused resistor, which is not subject to trimming. However, the resistance values of thin film resistors R1 and R2 can be conveniently adjusted by laser trimming to minimize the first and second derivatives of the bandgap cell output as a function of temperature.

Unfortunately, the square law voltage compensation produced by the FIG. 2 circuit is perfectly symmetrical, as opposed to the skewed parabolic shape of the Tln(T) deviation that actually characterizes the bandgap cell. Thus, the voltage correction that can be achieved with the FIG. 2 circuit is limited. FIG. 3 compares the Tln(T) and $T^2$ functions, scaled to a normalized value of the correction voltage $V_{corr}$. The resulting variation in the net $V_{bg}$, plotted on a normalized scale in which zero is the nominal $V_{bg}$, is illustrated in FIG. 4. This is a sideways S-shaped curve that exhibits a significant residual temperature coefficient in both the upper and lower portions of the temperature range.

SUMMARY OF THE INVENTION

The present invention seeks to provide a precise compensation for the Tln(T) deviation of a bandgap reference cell, without unduly complicating the circuitry or adding process steps, and with a compensation mechanism that is adjustable to account for manufacturing tolerances.

These goals are achieved by adding a relatively low TCR resistor in parallel with the high TCR tail resistor of a bandgap voltage reference as described in FIG. 2. This produces a resistance circuit that is non-linear with respect to temperature, such that when a proportional-to-absolute-temperature (PTAT) current is passed through it the voltage across the resistor circuit is very similar to the Tln(T) function. The ratio of resistance values between the two parallel resistors is selected so that, as a function of temperature, the rate of change in the cell's output voltage both with and without the parallel resistors is substantially zero at approximately the same temperature. This establishes a shape for the compensation voltage-temperature characteristic that closely matches the Tln(T) deviation. The absolute resistance values of the parallel resistors are selected so that the compensation scale matches to the deviation scale. The correction resistor is preferably implemented as a laser trimmable thin film resistor, formed from the same type of material as the other low TCR resistors in the circuit. The result is a highly accurate output correction that can be implemented with a minimum of additional elements and processing.

These and other features and advantages of the invention will be apparent to those skilled in the art from the following detailed description, taken together with the accompanying drawings.

DETAILED DESCRIPTION OF PREFERRED EMBODIMENTS

Figure 2:
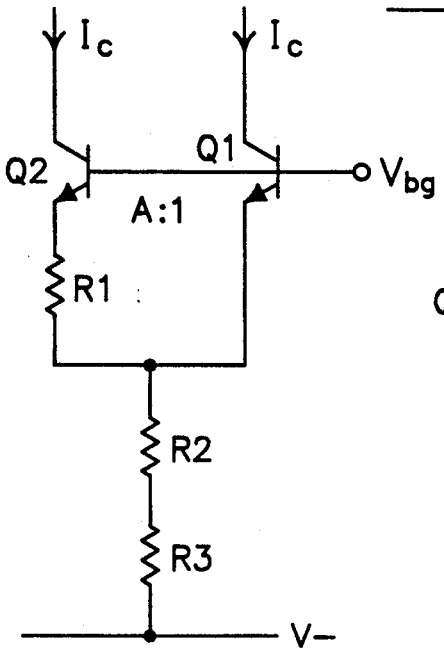
Fig.2 (Prior Art)
FIG. 2 is a schematic diagram of a known bandgap voltage reference circuit, described above, that partially compensates for the output deviation shown in FIG. 1.
Figure 5:
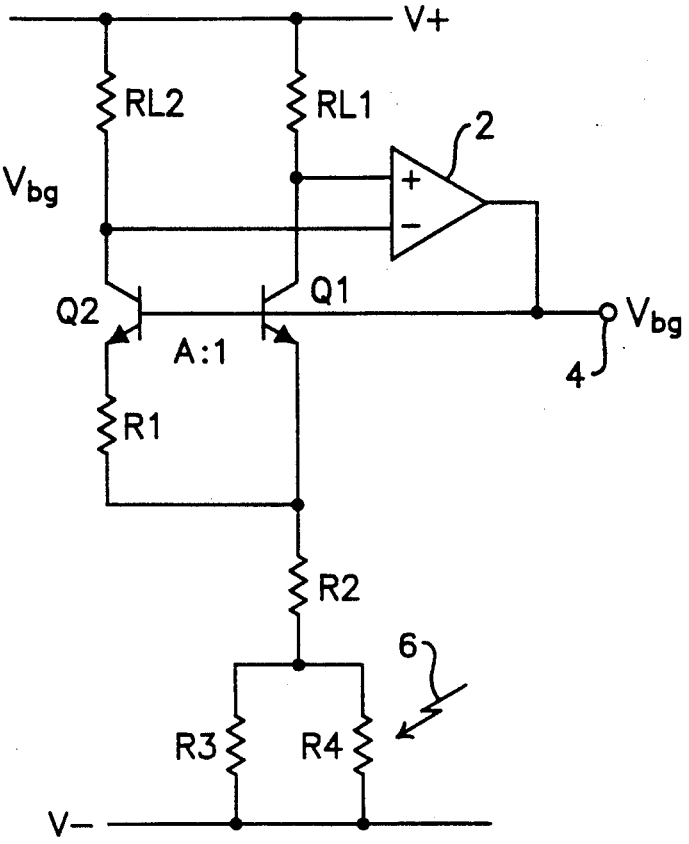
FIG. 5 is a schematic diagram of a bandgap voltage reference circuit that incorporates the present invention.

A bandgap voltage reference circuit that compensates for the Tln(T) deviation to achieve an essentially temperature-invariant output is shown in FIG. 5. Circuit elements that correspond to those of the prior bandgap reference cell shown in FIG. 2 are indicated by the same reference numerals.

Various known schemes are possible to establish a constant ratio of currents through Q1 and Q2 that does not vary significantly with temperature. One such technique, illustrated in the figure, is to connect low TCR load resistors RL1 and RL2 between the collectors of bandgap transistors Q1 and Q2, respectively, and a positive voltage bus V+. The voltages at the opposite sides of RL1 and RL2 from V+ are maintained at the same constant voltage levels by connecting these points respectively to the non-inverting and inverting inputs of an operational amplifier 2, the output of which is connected to the cell's output terminal 4. The operational amplifier 2 forces the voltages at its inputs to equal values, thus establishing currents through the load resistors RL1 and RL2 that are inversely proportional to their resistance values; the load resistor currents continue on as the collector currents of Q1 and Q2.

In accordance with the invention, an additional low TCR resistor R4 is connected in parallel with the relatively high TCR resistor R3. By a careful selection of the ratio of resistance values between R4 and R3, a voltage-temperature compensation can be achieved that has essentially the same shape as the Tln(T) output deviation of the circuit without R3 and R4, but with an inverted polarity. The absolute resistor values are then selected to equalize the scalings of the compensation and deviation voltages, so that the output deviation is essentially cancelled by the compensation voltage.

The low TCR resistors R1, R2 and R4 can all be formed in the same process step, and are preferably thin film resistors. Such resistors have a TCR on the order of 30 ppm, which is negligible for purposes of the invention. The high TCR resistor R3 can be implemented in various ways, such as by a diffused resistor with a TCR of about 1500 ppm/°C., a polysilicon resistor that also has a TCR of about 1500 ppm/°C., a p-well resistor with a TCR of about 8,000 ppm/°C. or a pinch resistor with a TCR of about 10,000 ppm/°C. An advantage of forming the low TCR correction resistor R4 as a thin film device is that such resistors are easily laser trimmable. As described below, R4 can be trimmed to compensate for fairly large fabrication tolerances without greatly disturbing the output voltage compensation.

Figure 6:
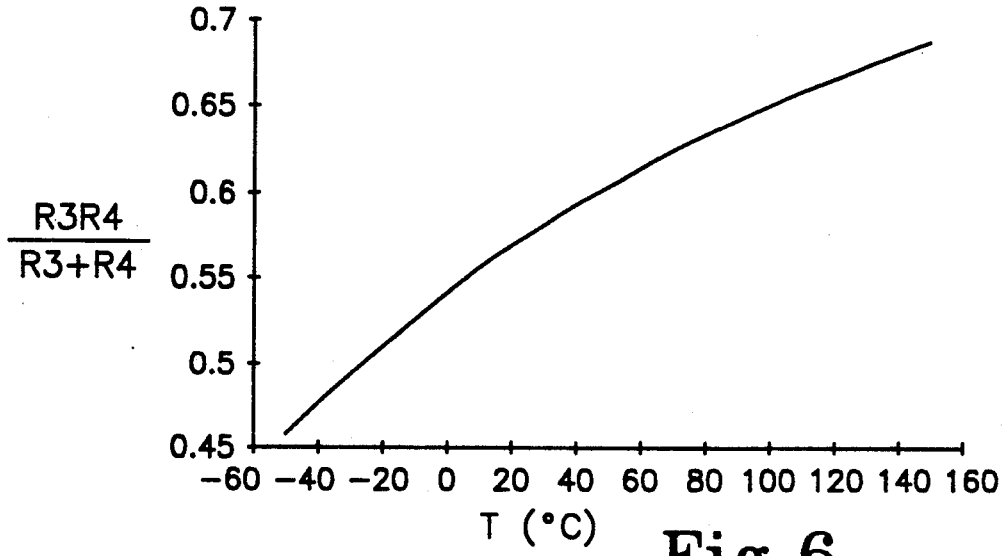
FIG. 6 is a graph illustrating the non-linearity, as a function of temperature, of the parallel resistor combination of FIG. 5.

FIG. 6 illustrates the non-linearity in the resistance of the R3/R4 parallel circuit as a function of temperature. Normalized resistance values and a unity resistance ratio were assumed for simplification. As described below, the invention takes advantage of this non-linearity to shape and scale a correction factor for the cell's Tln(T) output deviation.

It has been found that, as a function of temperature, the correction voltage ($V_{corr}$) across the R3/R4 parallel combination varies considerably with the ratio of the resistance value of R4 to R3. Computed traces of the correction voltage as a function of temperature for different resistance ratios are given in FIG. 7, with the resistance ratio increasing in increments of 0.5 from zero to eight. With a zero (short circuit) resistance for R4, the correction voltage is similarly zero. With a 0.5 ratio the correction voltage is slightly positive, but thereafter becomes increasingly negative as the ratio progressively increases. In addition to obtaining a larger scale, the shape of the correction voltage curve also shifts as the resistance ratio increases; the temperature at which the peak correction voltage occurs becomes progressively higher with an increasing resistance ratio. This phenomenon is utilized by the invention to select the particular resistor ratio for the most accurate output voltage correction.

Figure 7:
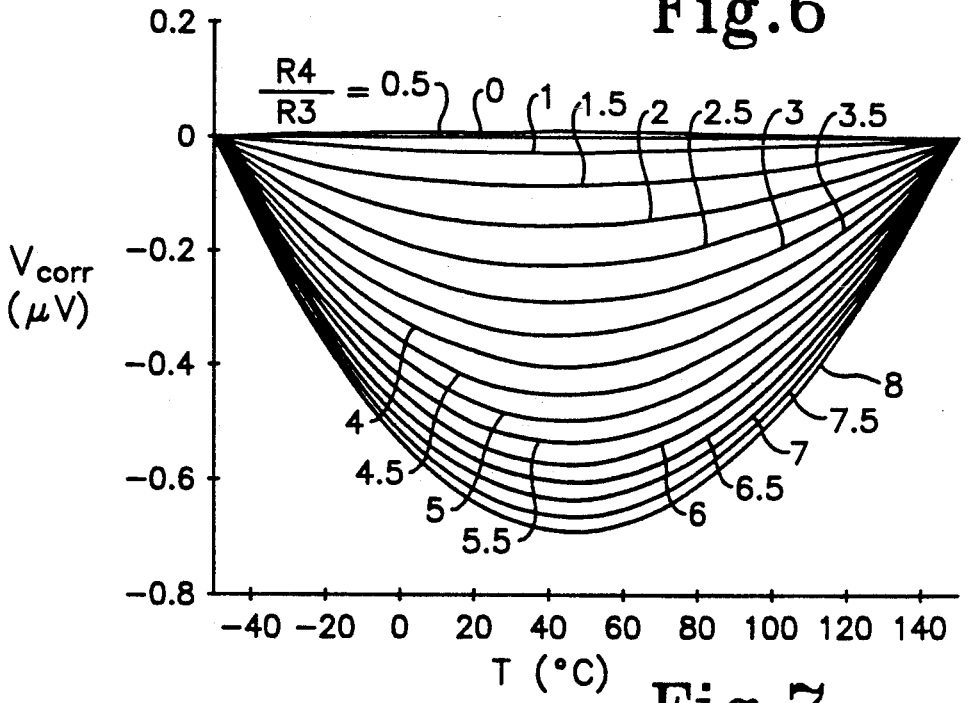
FIG. 7 is a graph illustrating a family of correction voltage-temperature curves achievable with the invention for different ratios between the low TCR correction resistor and the high TCR tail resistor.

It should be noted, from an inspection of the family of voltage-temperature curves in FIG. 7, that a first order effect of varying the resistance ratio is to change the absolute scale or size of the curvature correction, while the shift in the temperature at which the peak correction voltage is achieved is only a second order effect. Accordingly, so long as the resistance ratio is set at approximately the correct value to obtain a curvature correction curve with the proper shape, the resistance ratio can later be trimmed (by trimming the correction resistor R4) to maintain the output voltage correction without having a significant effect on the shape of the curvature correction. Such trimming may be called for if the desired resistance values for R3 and R4 are not obtained due to manufacturing tolerances. The high TCR resistor R3 will generally be implemented as a diffuse resistor, which is not subject to trimming. On the other hand, the use of thin film for the low TCR correction resistor R4 makes that device easily laser trimmable, as indicated by the trimming laser beam 6 indicated in FIG. 5. This is a valuable feature, since it allows the curvature correction to be trimmed by varying the value of R4 slightly, rather than having to trim the entire bandgap cell current.

Figure 1:
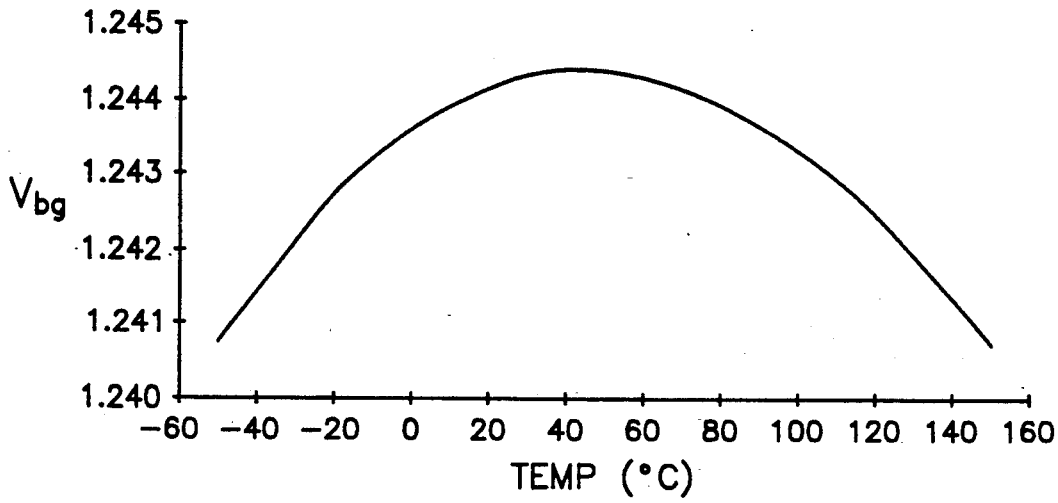
Fig.1 (Prior Art)
FIG. 1 is a graph of a typical Tln(T) deviation, described above, for a known bandgap voltage reference circuit.
Figure 3:
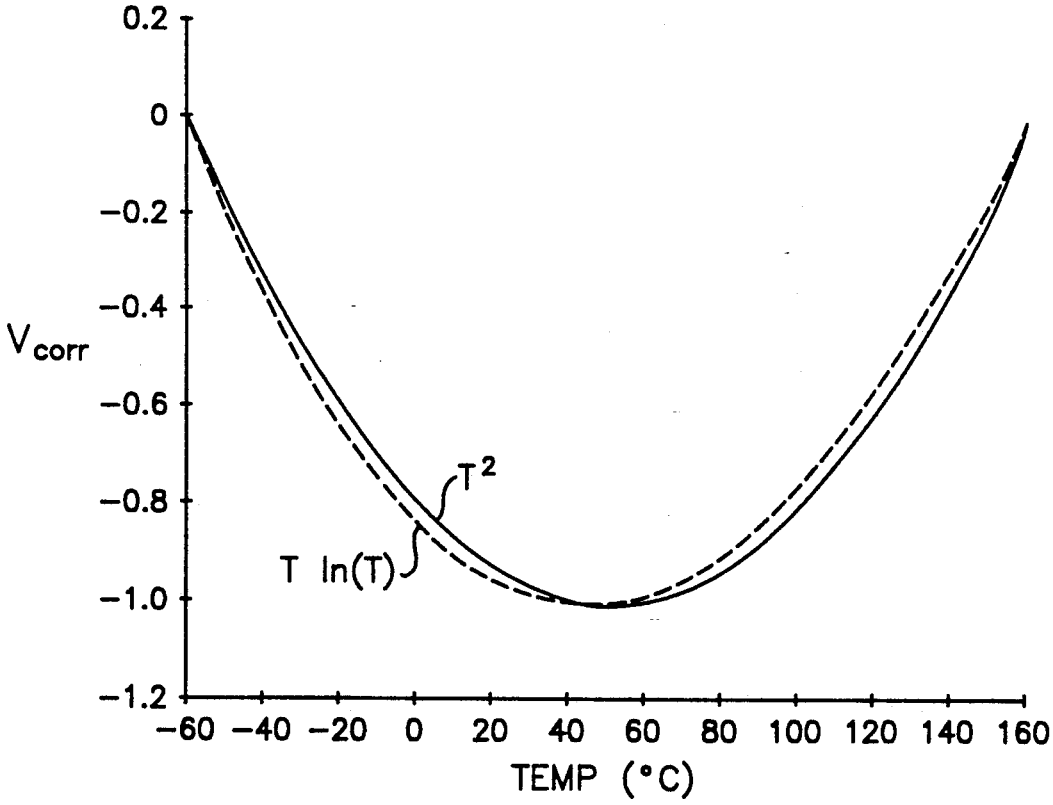
Fig.3 (Prior Art)
FIG. 3 is a graph, described above, comparing the Tln(T) deviation of a standard bandgap voltage reference circuit with the compensation provided by the circuit of FIG. 2.
Figure 8:
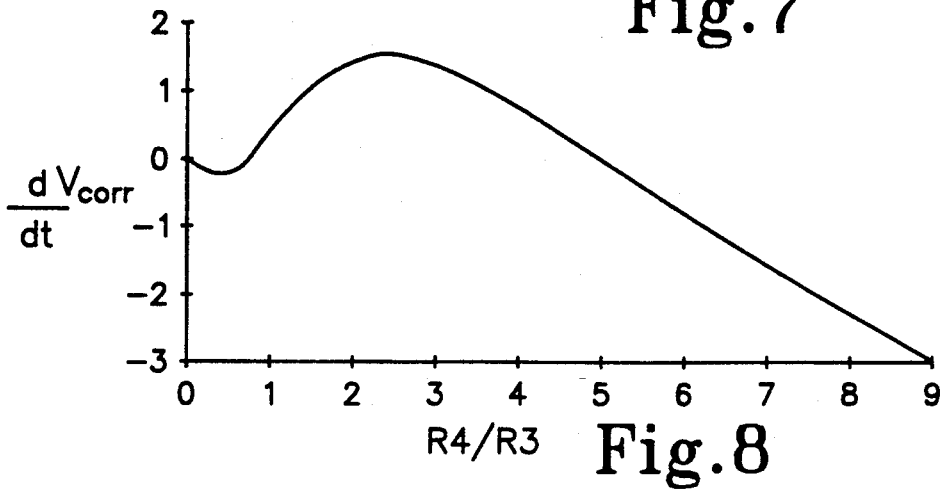
FIG. 8 is a graph plotting the slopes of the various curves in FIG. 7 at a temperature corresponding to the peak Tln(T) deviation temperature.

A precise output curvature correction is obtained by selecting the particular voltage correction curve that reaches a peak correction voltage at the same temperature at which the peak Tln(T) deviation occurs. For the deviation curve of FIG. 1, the peak deviation occurs at approximately 44.7° C. (FIG. 1 corresponds to a bandgap cell with R1 equal to 21.4 kohms, R2 equal to 121 kohms, transistor collector currents of 3 microamps, a transistor emitter area ratio of 10:1 and a transistor $V_{be}$ of 0.51773 volts.) The slopes of each of the curvature correction curves in FIG. 7 at 44.7° C. are plotted as a continuous curve in FIG. 8. It can be seen that zero slope values, which correspond to a peak correction voltage at 44.7° C., occur at R4/R3 ratios of 0, 0.7 and 5.0. A zero ratio can be ignored, since it corresponds to a short circuit, while a 0.7 ratio is undesirable because it is in the positive compensation portion of FIG. 7 and the compensation scale is very low. A resistor ration of about 5:1 is thus the preferred ratio for achieving an accurate output correction.

Now that the proper resistor ratio for the desired curvature correction curve shape has been determined, the absolute resistance values are computed by computing the curvature correction peak size as the differential between the values of the output deviation voltage at the ends of the temperature range and at the peak deviation temperature. The overall PTAT voltage produced by the high TCR resistor R3 is also computed, and the value of R2 is reduced to compensate for this PTAT voltage. The resulting output deviation, for the resistance parameters described above, is shown in FIG. 9. The voltage scale of this figure is greatly magnified, with each vertical division corresponding to only a single microvolt; the peak-to-peak output voltage deviation has been substantially reduced down to about 5 microvolts.

Figure 4:
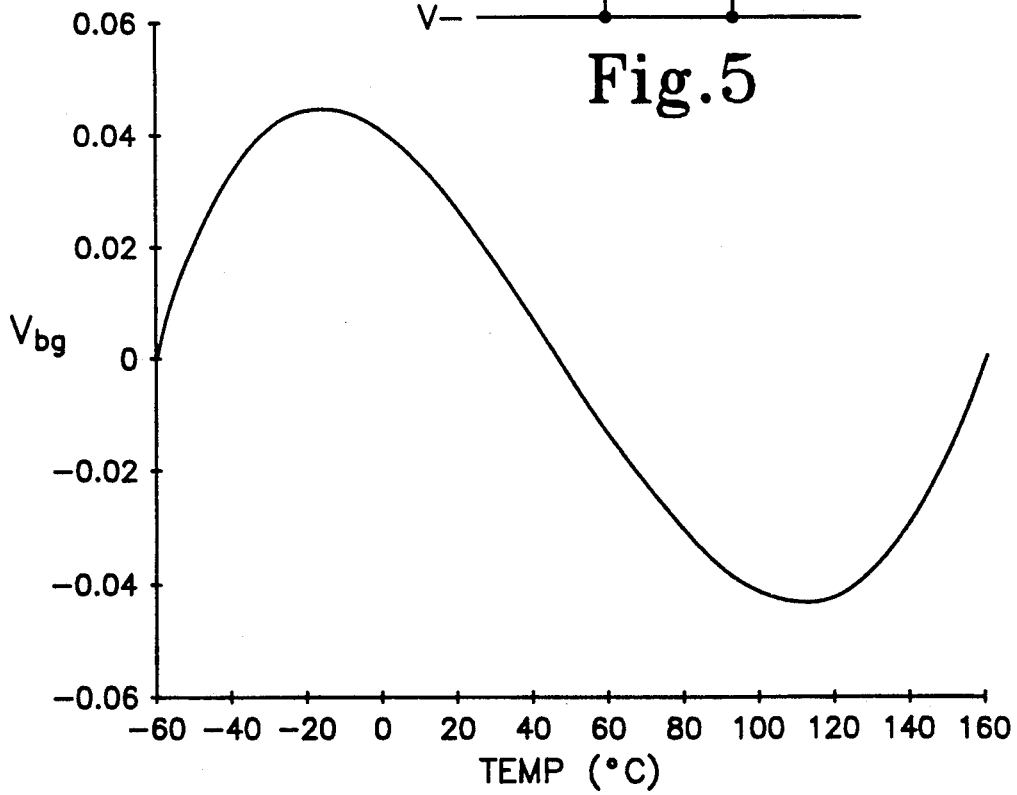
Fig.4 (Prior Art)
FIG. 4 is a graph, described above, illustrating the voltage output obtained with the circuit of FIG. 2.
Figure 9:
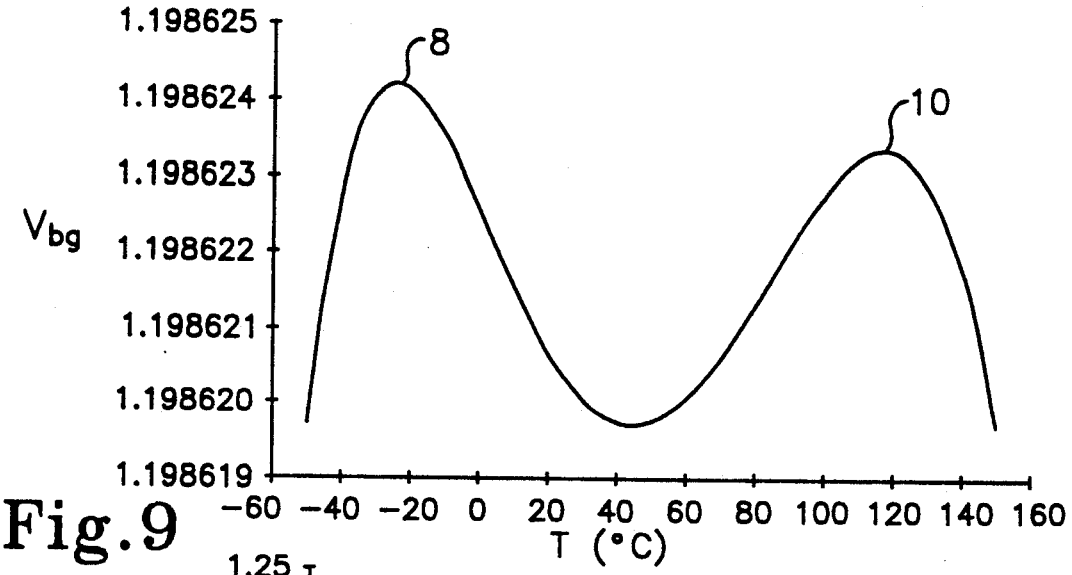
FIG. 9 is a graph illustrating the voltage output achievable with the invention.

The output characteristic in FIG. 9 has a pair of humps 8 and 10 that represent a third order correction, as compared the S-shaped output of a second order (square law) curvature correction illustrated in FIG. 4 for the circuit without the correction resistor R4. Also note that the absolute value of the output deviation in FIG. 9 is on the order of $10^4$ times less than the deviation in FIG. 4.

FIG. 9 represents an optimized output that is theoretically obtainable if there are no other sources of output deviation. However, a hysterisis in the transistor operation as the temperature increases to the upper end of the desired range and then cools back down to room temperature typically introduces a greater output randomness, on the order of perhaps 100 microvolts, than the degree of accuracy indicated by FIG. 9. The presence of transistor hysterisis mitigates the effect upon absolute output temperature linearity that would otherwise result from trimming the correction resistor R4 and thus changing the R4/R3 resistor ratio. Any loss in output accuracy from trimming R4 would tend to be masked by the hysterisis effect, but the hysterisis deviation is still several orders of magnitude less than the residual deviation that can be expected with a square law output correction.

Figure 10:
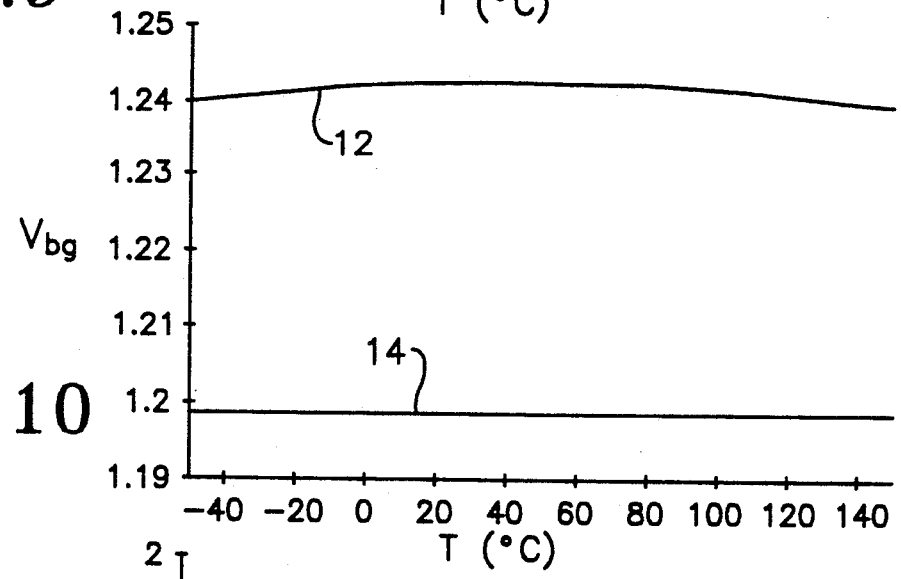
FIG. 10 is a graph comparing the bandgap voltage outputs with and without the correction provided by the invention.

A comparison of the bandgap cell's output, with and without the curvature correction provided by the invention, is illustrated in FIG. 10 for a circuit with parameters as described above. Curve 12 represents the uncorrected output, while curve 14 represents the output after the addition of the curvature correction. Due to the voltage scale employed, the corrected output appears to be perfectly flat as a function of temperature, while the uncorrected output has a distinct bow.

Figure 11:
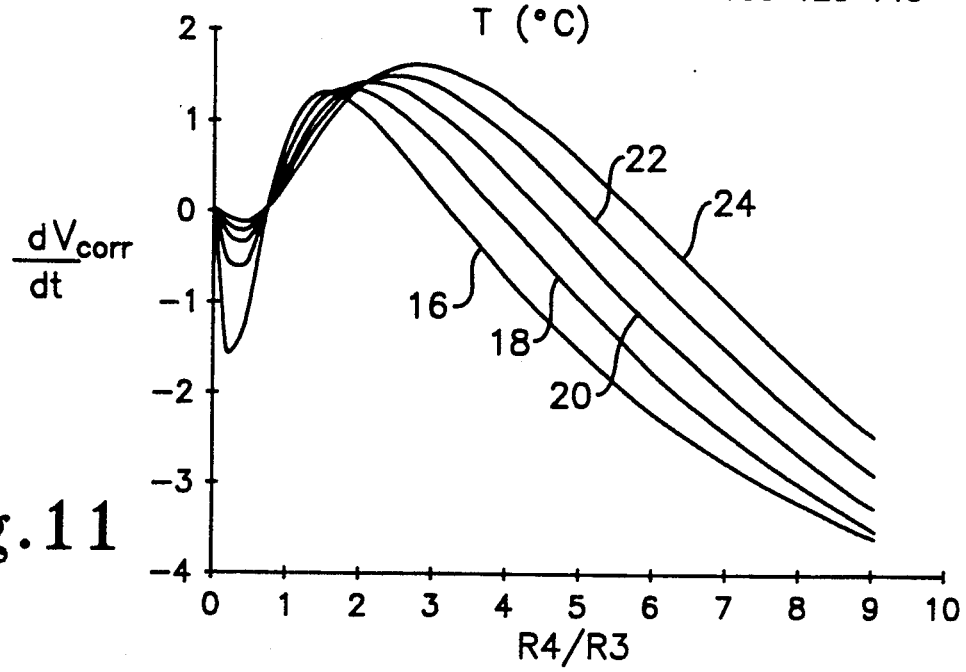
FIG. 11 is a family of curves similar to FIG. 8, showing the effects upon the ideal resistor ratio of varying the TCR of the high TCR tail resistor.

The particular R4/R3 resistance ratio at which accurate curvature correction is obtained will depend upon the parameters of the particular circuit being considered. For example, the curve of FIG. 8 was obtained with an assumed TCR for R3 of 6,880 ppm/°C. FIG. 11 presents modified curves of the correction voltage-temperature slope, as a function of the resistor ratio, for different values of R3 TCR. Curves 16, 18, 20, 22 and 24 correspond respectively to TCRs of 4,000, 5,000, 6,000, 7,000 and 8,000 ppm/°C. for R3. It can be seen from these curves that the optimum resistor ratio increases progressively from a value of about 3.2 for curve 16 to a value of about 5.7 for curve 24.

While particular embodiments of the invention have been shown and described, numerous variations and alternate embodiments that employ a relatively low TCR correction resistor in parallel with a relatively high TCR tail resistor will occur to those skilled in the art. Accordingly, it is intended that the invention be limited only in terms of the appended claims.

I claim:

1. In a bandgap voltage reference circuit having a tail resistance, a first portion of said tail resistance having a relatively high temperature coefficient of resistance (TCR) and a second portion having a relatively low TCR and connected in series with said first portion, said circuit producing an output voltage that exhibits a generally Tln(T) deviation from a linear output voltage-temperature relationship in the absence of said relatively high TCR portion, where T is absolute temperature, the improvement comprising:

a relatively low TCR resistance means connected in parallel with the relatively high TCR portion of said tail resistance and in series with the relatively low TCR portion of said tail resistance said relatively low TCR resistance means having a resistance value and TCR that, together with said relatively high TCR portion of said tail resistance, substantially compensates for said Tln(T) deviation.

2. The bandgap voltage reference circuit of claim 1, said tail resistance comprising a relatively low TCR resistor connected in series with a relatively high TCR resistor.

3. The bandgap voltage reference circuit of claim 2, wherein the ratio of resistance values between said relatively low TCR resistance means and said relatively high TCR resistor is selected so that, as a function of temperature, the rate of change in said output voltage both with and without said relatively low TCR resistance means and said relatively high TCR portion is substantially zero at approximately the same temperature.

4. The bandgap voltage reference circuit of claim 3, wherein the absolute resistance values of said relatively high TCR resistor and said low TCR resistance means are selected to substantially compensate for the scale of said Tln(T) deviation.

5. The bandgap voltage reference circuit of claim 3, wherein said ratio of resistance values is selected to provide a negative compensation for said Tln(T) deviation.

6. The bandgap voltage reference circuit of claim 2, wherein said relatively low TCR resistance means comprises a thin film resistor.

7. The bandgap voltage reference circuit of claim 6, wherein said relatively low TCR resistance means comprises a trimmed thin film resistor.

8. The bandgap voltage reference circuit of claim 2, wherein said relatively low TCR resistance means is formed from the same type of material as said relatively low TCR tail resistor.

9. A bandgap voltage reference circuit, comprising:

a pair of transistors having respective bases, collectors and emitters, an output voltage terminal connected to the bases of said transistors, means for establishing unequal emitter current densities in said transistors, a first resistor having a relatively low temperature coefficient of resistance (TCR) connected between the emitters of said transistors, second and third resistors having respective relatively low and relatively high TCRs connected in series between the emitter of one of said transistors and a voltage reference, and a fourth resistor having a relatively low TCR connected in parallel with said third resistor, the TCRs of said third and fourth resistors and the ratio between their resistance values being selected to substantially compensate for a Tln(T) deviation from linearity in the voltage at said output terminal that is present in the absence of said third and fourth resistors, where T is absolute temperature.

10. The bandgap voltage reference circuit of claim 9, wherein the ratio of resistance values between said third and fourth resistors is selected so that, as a function of temperature, the rate of change in said output voltage both with and without said third and fourth resistors is substantially zero at approximately the same temperature.

11. The bandgap voltage reference circuit of claim 10, wherein the absolute resistance values of said third and fourth resistors are selected to substantially compensate for the scale of said Tln(T) deviation.

12. The bandgap voltage reference circuit of claim 9, wherein said fourth resistor comprises a trimmed thin film resistor.

13. A bandgap voltage reference circuit, comprising:

a pair of transistors having respective bases, collectors and emitters, an output voltage terminal connected to the bases of said transistors, means for providing collector currents to said transistors, a first resistor having a relatively low temperature coefficient of resistance (TCR) connected between the emitters of said transistors, second and third resistors having respective relatively low and relatively high TCRs connected in series between the emitter of one of said transistors and a voltage reference, and a fourth resistor having a relatively low TCR connected in parallel with said third resistor, said parallel resistors substantially cancelling temperature dependent deviations in the voltage at said output terminal over a desired temperature range.

14. A bandgap voltage reference circuit, comprising:

a pair of transistors having respective bases, collectors and emitters, an output voltage terminal connected to the bases of said transistors, means for providing collector currents to said transistors, a first resistor having a relatively low temperature coefficient of resistance (TCR) connected between the emitters of said transistors, a second resistor having a relatively low TCR, and a correction circuit connected in series with said second resistor between the emitter of one of said transistors and a voltage reference, said correction circuit having a non-linear resistance-temperature characteristic selected to substantially cancel temperature dependent deviations in the voltage at said output terminal over a desired temperature range.

15. The bandgap voltage reference circuit of claim 14, said correction circuit comprising third and fourth resistors having respective relatively high and low TCRs and connected in parallel with each other.

16. A method of correcting the output voltage of a bandgap voltage reference circuit to compensate for a Tln(T) output voltage deviation, where T is absolute temperature, said circuit having a relatively low temperature coefficient of resistance (TCR) tail resistor in series with a relatively high TCR tail resistor, comprising the steps of:

determining the peak deviation temperature at which the rate of change of said output voltage as a function of temperature is substantially zero, adding a relatively low TCR correction resistor in parallel with said relatively high TCR tail resistor and in series with said relatively low TCR tail resistor, and selecting a ratio of resistance values for said relatively high TCR tail resistor and said relatively low TCR correction resistor at which said Tln(T) output voltage deviation is substantially compensated the rate of change of the voltage across said parallel resistors, as a function of temperature, is substantially zero at said peak deviation temperature.

17. The method of claim 16, wherein the resistance values of said relatively high TCR tail resistor and of said relatively low TCR correction resistor are selected to substantially compensate for the scale of said Tln(T) deviation.

18. The method of claim 17, further comprising the step of trimming said correction resistor to obtain a desired scaling of the output correction.

19. The method of claim 18, wherein said correction resistor is added as a thin film resistor.

* * * * *